United States Patent [19]

Newton, Jr.

[11] Patent Number: 4,561,650

[45] Date of Patent: Dec. 31, 1985

[54] TILT ADJUSTABLE STARTING BLOCK

[76] Inventor: Milton A. Newton, Jr., 4392 Pampas Rd., Woodland Hills, Calif. 91364

[21] Appl. No.: 510,203

[22] Filed: Jun. 29, 1983

[51] Int. Cl.[4] ..... A63K 3/02

[52] U.S. Cl. ..... 272/105

[58] Field of Search ..... 272/105, 96, 62, 61; 273/187 R, 187 B, 188 A, 188 R, 73 L, 81.2; 128/25 B

[56] References Cited

U.S. PATENT DOCUMENTS

| | | | |
|---|---|---|---|
| 1,548,175 | 8/1925 | Roseborough | 272/62 |
| 2,021,801 | 11/1935 | Meyer | 128/25 B |
| 2,534,159 | 12/1950 | Brouwer et al. | 272/105 |
| 2,699,182 | 1/1955 | Baldridge | 273/81.2 |
| 3,799,542 | 3/1974 | Potgieter | 272/105 |
| 4,089,519 | 5/1978 | Newton | 272/105 |
| 4,124,317 | 11/1978 | Dauth | 272/62 |
| 4,252,313 | 2/1981 | Skalka | 272/62 |
| 4,337,939 | 7/1982 | Hoyle et al. | 272/96 |

FOREIGN PATENT DOCUMENTS

| | | | |
|---|---|---|---|
| 2507468 | 9/1976 | Fed. Rep. of Germany | 272/105 |
| 2000606 | 9/1969 | France | 273/73 L |

*Primary Examiner*—Richard J. Apley
*Assistant Examiner*—S. R. Crow
*Attorney, Agent, or Firm*—Howard L. Johnson

[57] ABSTRACT

A runner's starting block such as is attachable, one on each side of a longitudinal alignment frame, in staggered relation, so as to position each foot of a runner at a selected position for the start of a race. The block can have the tilt of its foot contact plate minutely adjusted to the liking of each particular runner, by interacting screw and nut elements terminally pivoted to move the rear of the foot contact plate, which setting is readable in degrees and accordingly reproducible on other similar blocks. Block also has extension plate adjustable to support heel or instep of runner's shoe as desired.

5 Claims, 6 Drawing Figures

TILT ADJUSTABLE STARTING BLOCK

BACKGROUND

In my U.S. Pat. No. 4,089,519 issued May 16, 1978 was shown a Starting Block Assembly having a left and right pair of starting blocks, individually locatable at selected, longitudinally separated locations along a central alignment frame or bar. There have also been various constructions for making each foot block tiltable (different for each foot) by providing a small sequence of abutment lugs or slots against which a rear support could be lodged. Examples of this are the U.S. Pat. Nos. 1,990,497 Niday 1935; 2,004,172 Niday 1935; 3,401,931 McCafferty 1968; 3,724,843 Fichter 1973. Ultimately some attempt was made for smaller gaps in tilt adjustability by placing a larger number of small "stops" very close together, or alternately by a hand-knob controlled leverage linkage, as seen in West German Pat. No. 2,507,468 to Fischer, published Sept. 9, 1976. However, direct "continuous" non-stepwise adjustability of a tiltable footplate (which must maintain its set position against considerable back pressure from the runner's foot) has remained unavailable.

STATEMENT OF THE INVENTION

Accordingly it is an object to provide such a starting block of which the tiltable foot contact plate is continuously screw adjustable—and automatically anchored at any stop position—through a wide span of movement, between elevated and reclined limit positions. Intermediate positions are visibly marked in degrees on an elevating screw so that a favored slant (for each foot) can be readily reproduced on the same or on a distant pair of blocks. Thus, if such a starting block assembly is available at each track, the runner can set it to his predeveloped setting; and need not carry his own set of blocks from one running track to another.

The invention provides two piece positioning or elevating means pivotally coupling the rear of the tiltable foot contact plate to a central support post located atop a base plate, such means exemplified by a non-rotatable, threaded shaft, longitudinally displaceable within an angular bore of the post and (manually) operable by a carried nut which is itself restrained by a particular post connection, against linear movement along the shaft. This structure is self anchoring and thus does not "unwind" under back pressure from the runner's foot against the contact plate.

Additionally, the foot contact plate is provided with an extension plate, selectively projectable above the upper edge of the tilt plate and thus adjustable to support the shoe instep or heel area of a particular runner as he may wish for each foot.

DETAILED DESCRIPTION OF PREFERRED EMBODIMENT

Figures 1, 2, 3, 4, 5, 6:
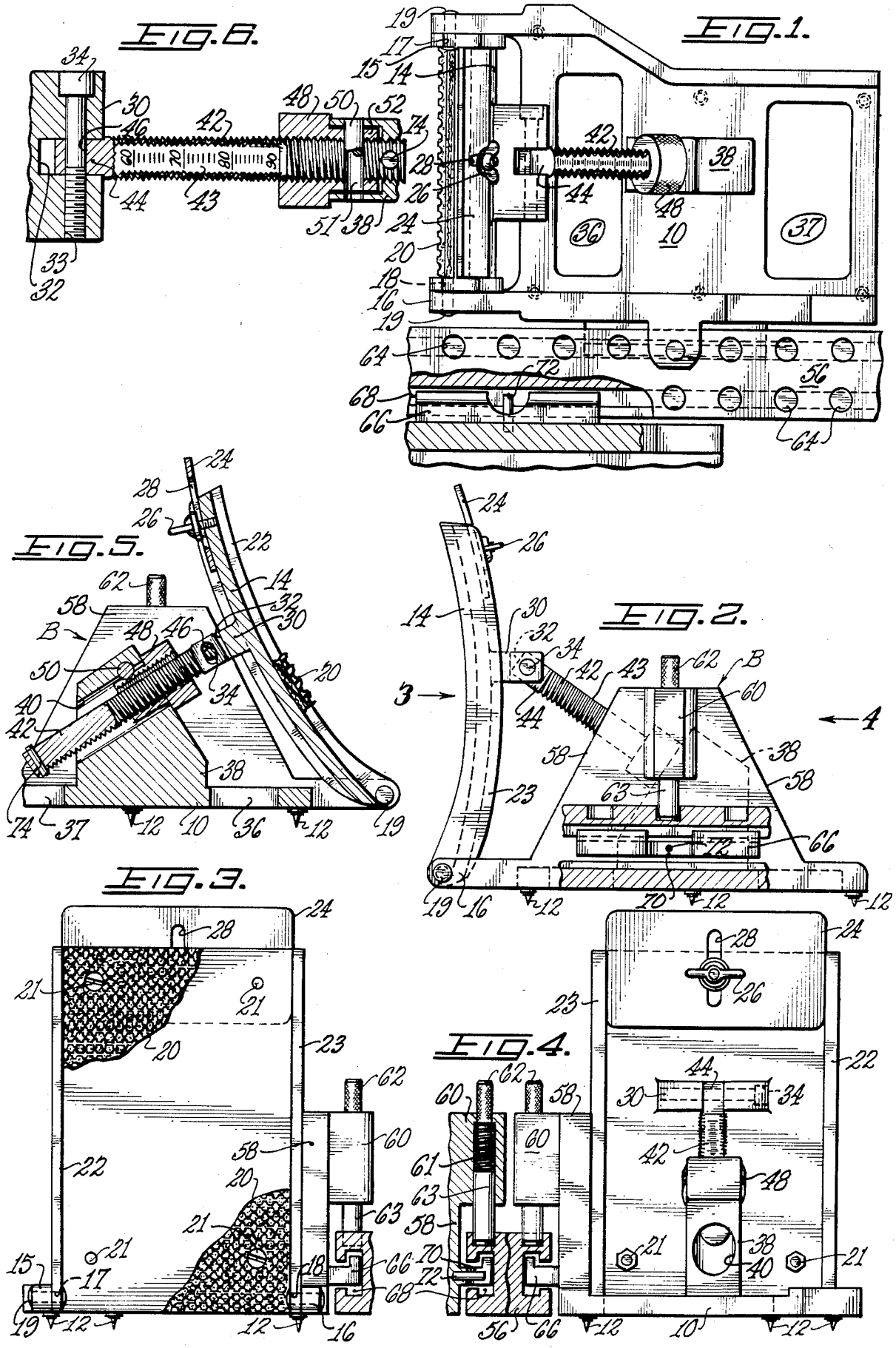
FIG. 1 is a plan view of one starting block and fragmental portion of another, connected in longitudinally staggered relation to a central alignment bar or frame.
FIG. 2 is a side elevational view of an attached starting block with a segment of the alignment bar in vertical longitudinal section and the foot plate shown in maximum forward extension.
FIG. 3 is an end elevational view as seen from the left of FIG. 2, showing the block coupled to the alignment bar.
FIG. 4 is an end elevational view as seen from the right of FIG. 2 with the alignment bar coupled to a pair of blocks.
FIG. 5 is a longitudinal vertical section through a partially reclined block, particularly showing the elevating mechanism.
FIG. 6 is a detail view of the elevating mechanism or threaded shaft particularly showing its terminal connections, in longitudinal section.

The invention provides a starting block B having a generally flat-bottom casting or base plate 10 which on its underface may carry downward extending spikes 12 for anchorage penetration of underlying ground or turf. Pivotally attached to the forward edge of the base plate is a somewhat concave, foot contact plate 14. Forming corners of the base plate are a pair of hinge bearing tubes 15, 16 FIG. 3 located along its lower margin and aperture-aligned with corresponding bores 17, 18 of the edge rim of the base plate. Each pair of the two thus aligned socket tubes are held together by a transverse hinge pin 19. The concave forward face of the contact plate 14 may seat a corresponding contact pad 20, adhesively attached or press fit between the respective edge rims 22, 23; alternately or in addition the contact pad may be bolted to the surface of the tilted face by fasteners 21. Conveniently such pad is formed of resilient material such as natural and/or synthetic rubber, synthetic plastic or other cushioning material including natural fiber.

Extending across the upper margin of the foot contact plate 14 is a metal extension plate 24 adjustably held in juxtaposition with the rear face of the plate by a wing nut 26 or similar fastener which has its threaded shaft received through a vertical slot 28 of the extension plate. When the nut 26 is loose, the extension plate can be slid upward to such position as to support the instep or heel area of the particular user's shoe (and there tightened). Alternately, it can be pushed downward so as to be completely covered by the contact plate, as when the user does not desire to use it at all, or when storing or carrying the unit.

Projecting from the rear face of the contact plate 14 is a bifurcate coupling attachment 30 formed with a rear-opening tongue-slot 32 (FIG. 6) and a transverse bore 33 which receive a pivot pin 34 which traverses both the bifurcate structure and its slot 32.

The base plate 10 is cast with two open areas 36, 37 and a central upstanding support post or tower 38 which latter has a forwardly upslanted, smooth bore or channel 40. The coupling attachment 30 and the support post 38 are connected by a two-piece elevating or positioning mechanism including a threaded support shaft or screw 42 which is rendered nonrotatable by having a terminal flat-sided tongue 44 received in the coupling slot 32 and loosely held by a pin 34 inserted through a laterally enlarged aperture 46 (FIG. 5) which allows lateral movement of the pin so as to accommodate shift of the upslanted positions of the forward contact plate 14 between those shown in FIGS. 2 and 5. Such shift is effected by (manual) rotation of a nut 48 carried by the threaded shaft 42 and held against its own axial displacement by a transverse pin 50 (FIGS. 5–6) which traverses a bore of the tower 38 with its midlength riding in a circumferential groove 51 of a reduced neck 52 of the control nut 48. A longitudinal, flat-top length or surface 43 of the threaded support shaft carries numerical indicia indicating the corresponding degrees of elevation, between extreme end positions, of the foot plate 14. Thus the fixed pin 50 seated in the peripheral groove 51 provides restraining means against lengthwise travel of the nut along the shaft and causes the latter to move lengthwise instead in the channel 40 so as to bring the pivotally supported foot contact plate 14 to a selected tilt. The heart of the elevating mechanism is thus the two-piece positioning means consisting of interengaging screw 42 and nut 48 of which one piece is restrained from rotary movement in order to enable longitudinal movement of the other piece.

Each pair of starting blocks, along one side carries attachment means for its coupling to a central alignment frame or rod 56. Located along one side margin of the base plate 10, depending on whether it is made for right or left side attachment, is an upstanding wall 58. Along its outer side it carries a tubular housing 60 for a spring-loaded 61 attachment pin 62 which extends beyond both ends of the housing, so that its lower end 63 is insertable in a selected one of a series of upward-opening sockets 64 which are spaced a unit distance apart (e.g. one inch or 2.5 cm.) along the top surface of the frame 56. From the lower outer margin of the lateral wall 58 projects an L-shaped runner 66 which is lengthwise movable along a T-shaped, lengthwise slideway 68 of the frame. Such a T-apertured frame and corresponding block attachment means are shown in my earlier cited patent. However the present starting block may be modified for coupling to any other alignment frame or rod which is available, and its usage is not limited to its usage with the here illustrated alignment frame 56.

The runner 66 may be cast integral with the base plate 10 or, when formed of a different metal, such as brass, may be bolted or otherwise fastened thereto. It is formed with a central cut-out area 70 from which a stop pin 72 (FIG. 1) projects so as to support the contact end 63 of the attachment pin 62 when not received in a socket 64. At the lower end of the threaded shaft 42, a diametrically projecting stop pin 74 (FIG. 5) prevents complete (forward) withdrawal of the shaft 42 from the (post-retained) nut.

I claim:

1. A starting block comprising a base plate and a forward-facing foot contact plate disposed pivotally upstanding from a leading edge of the base plate, said base plate carrying selectively adjustable elevating mechanism adapted to progressively tilt and hold the foot contact plate at a selected tilt between upstanding and reclined positions, said elevating mechanism comprising support means carried by the base plate including elongated, two-piece positioning means having an upslanted forward end pivotally connected to a rear surface of the foot contact plate, one piece of said positioning means comprising a threaded shaft and the other piece comprising an operating nut threadedly carried by said shaft, one of said pieces being lengthwise displaceable relative to the other when the other is held stationary, whereby rotation of the rotatable piece may effect extension or contraction of said positioning means toward or away from the pivotally connected foot contact plate so as to determine the tilt of said foot contact plate and to support it from the rear so as to oppose back pressure of a user's foot when pressed against the forward face of the foot contact plate.

2. A starting block according to claim 1 wherein said foot contact plate additionally carries a generally flat, extension plate adjustably lodged in planar registration with an upper width of said contact plate, the extension plate having means for anchorage at selected positions of projection beyond the upper edge of the foot contact plate, thereby to support the heel area of a runner's shoe.

3. The combination comprising a pair of the starting blocks of claim 1 and a longitudinal alignment frame having each of said blocks coupled to a respective side thereof at a selected location so as to support each foot of a runner at a desired starting position.

4. A starting block according to claim 1 wherein said positioning means carries positional indicia corresponding to the degree of elevation of said foot contact plate.

5. A starting block according to claim 1 wherein said foot contact plate has an overlying contact pad.

* * * * *